US006310430B1

(12) United States Patent
Moriya

(10) Patent No.: US 6,310,430 B1
(45) Date of Patent: Oct. 30, 2001

(54) SPARK PLUG HAVING A METALLIC TERMINAL WITHIN A THROUGH-HOLE

(75) Inventor: Toru Moriya, Aichi (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 0 days.

(21) Appl. No.: 09/271,289

(22) Filed: Mar. 17, 1999

(30) Foreign Application Priority Data

Mar. 18, 1998 (JP) ..... 10-090981

(51) Int. Cl.[7] ..... H01T 13/20

(52) U.S. Cl. ..... 313/141; 313/142; 123/169 EL; 123/169 R

(58) Field of Search ..... 313/141, 142; 123/169 EL, 169 R

(56) References Cited

U.S. PATENT DOCUMENTS

| | | | | |
|---|---|---|---|---|
| 965,380 | * | 7/1910 | Estes et al. | 313/142 |
| 1,090,815 | * | 3/1914 | Harter | 313/141 |
| 2,871,389 | * | 1/1959 | Skunda | 313/141 |
| 2,988,662 | * | 6/1961 | Smith | 313/141 |
| 5,406,166 | * | 4/1995 | Abe et al. | 313/141 |

FOREIGN PATENT DOCUMENTS 62-167391 10/1987 (JP) .

* cited by examiner

*Primary Examiner*—Nimeshkumar D. Patel
*Assistant Examiner*—Mariceli Santiago
(74) *Attorney, Agent, or Firm*—Finnegan, Henderson, Farabow, Garrett & Dunner, L.L.P.

(57) ABSTRACT

A spark plug for attachment to a cylinder head includes a metallic shell including a tip-end side having an open tip end and a tail-end side having an open tail end. The metallic shell has an attachment screw portion peripherally formed at the tip-end side thereof. The spark plug also includes a ground electrode attached onto the tip-end side of the metallic shell, and an insulator including an axial through-hole formed therein and a tail end portion having a tail end. The insulator is disposed within the metallic shell such that the tail end portion of the insulator substantially projects from the tail end of the metallic shell. A center electrode has a tip end and being disposed within the through-hole and facing the ground electrode to define a spark discharge gap therebetween, and a metallic terminal has a tail end and being disposed within the through-hole of the insulator such that the tail end of the metallic terminal is set back from the tail end of the insulator into the through-hole. The metallic terminal is electrically connected with the center electrode. The metallic terminal and the tail end of the metallic shell are separated with a distance for preventing an electrical discharge therebetween, and wherein, when A represents a distance between the tail end of the insulator and the tail end of the metallic terminal disposed within the through-hole, and B represents a length of the tail end portion of the insulator projecting from the tail end of the metallic shell along the axial direction of the through-hole of the insulator, a length of (A+B) is at least 20 mm.

13 Claims, 6 Drawing Sheets

SPARK PLUG HAVING A METALLIC TERMINAL WITHIN A THROUGH-HOLE

BACKGROUND OF THE INVENTION

1. Field of the Invention

The present invention relates to a spark plug used in an internal combustion engine, such as an automobile engine.

2. Description of the Related Art

As shown in FIG. 7, a spark plug 200 is used to ignite an air-fuel mixture in an internal combustion engine, such as an automobile gasoline engine. The spark plug 200 is attached to a cylinder head SH of the engine by an attachment screw portion 201*a* formed on the peripheral surface of a metallic shell 201. In the installed condition, a spark discharge gap g defined by a ground electrode 204 and a center electrode 203 is located within a combustion chamber K and is used to ignite an air-fuel mixture. The electrodes which define the spark discharge gap g are exposed to a combustion gas while the engine is operating, and thus rises to a considerably high temperature.

In recent years, as a power output of an internal combustion engine used in, for example, an automobile increases, an area occupied by an inlet valve and an exhaust valve within the combustion chamber has been increasing. Accordingly, the spark plug must become more compact.

Additionally, due to employment of a supercharger, a turbocharger, or the like, the temperature within the combustion chamber tends to increase more and more.

In order to attain a sufficiently long life of a spark plug under such severe working conditions, heat must be sufficiently radiated from the electrode portions. The heat is radiated from the spark plug in various passages. Particularly, a heat-radiation passage from an insulator 202 to the cylinder head SH via the attachment screw portion 201*a* exhibits a large heat flow and plays an important role in sufficient heat radiation. In popular spark plugs, the length of the attachment screw portion 201*a* (screw reach) is as high as 19 to 20 mm even in those of the so-called long reach type. Recently, the screw reach of a spark plug has been lengthened to improve the heat radiation performance of the spark plug.

As is evident from FIG. 7, when the screw reach of the spark plug 200 increases, the overall length of the insulator 202 must increase accordingly. The insulator 202 is generally manufactured by the steps of: compacting a powder of alumina or a similar material by a rubber press or a similar apparatus; lathing or machining the peripheral surface of the compacted body; and sintering the lathed compacted body. However, if the insulator 202 is excessively long, the compacted body may incur eccentric rotation during the lathing process, or the lathed compacted body may bend during the sintering process. These may potentially result in manufacturing deterioration because of unsatisfactory dimensional accuracy. The increase in the length of the insulator 202 leads to a weight increase of the spark plug 200, potentially loosening a caulked portion 201*b* of the metallic shell 201 because of excessive inertia of the spark plug 200 upon exposure to vibration or impact.

To prevent excessive increase in the overall length of the insulator 202, the length of a projecting portion 202*a* of the insulator 202 projecting from the tail end of the metallic shell 201 may conceivably be decreased. However, if the length of the projecting portion 202*a* becomes too short, a discharge may occur between a tail end portion of the center electrode 203 (terminal electrode 205) and the metallic shell 201 along the surface of the projecting portion 202*a*. This discharge is called a flashover phenomenon. Accordingly, to avoid the flashover phenomenon, the projecting portion 202*a* cannot be shortened beyond a certain length, which is at least 25 mm according to the common standard in the art.

SUMMARY OF THE INVENTION

An object of the present invention is to provide a spark plug whose screw reach is relatively long to attain an excellent heat radiation, whose overall insulator length is not excessively long to achieve a good productivity, and which is less susceptible to flashover.

Additional objects and advantages of the invention will be set forth in part in the description which follows, and in part will be obvious from the description, or may be learned by practice of the invention. The advantages and purpose of the invention will be realized and attained by the elements and combinations particularly pointed out in the appended claims.

To achieve the above object, the present invention provides a spark plug comprising a center electrode, a metallic shell, a ground electrode, an insulator, and a metallic terminal.

The spark plug has a metallic shell including a tip-end side having an open tip end and a tail-end side having an open tail end. The metallic shell also has an attachment screw portion peripherally formed at the tip-end side thereof. A ground electrode attaches onto the tip-end side of the metallic shell. An insulator includes an axial through-hole formed therein and a tail end portion having a tail end and is disposed within the metallic shell such that the tail end portion of the insulator substantially projects from the tail end of the metallic shell. A center electrode has a tip end and is disposed within the through-hole and facing the ground electrode to define a spark discharge gap therebetween. A metallic terminal has a tail end and is disposed within the through-hole of the insulator such that the tail end of the metallic terminal is set back from the tail end of the insulator into the through-hole, the metallic terminal being electrically connected with the center electrode. The metallic terminal and the tail end of the metallic shell are separated with a distance for preventing an electrical discharge therebetween.

In the spark plug of the present invention, the attachment screw portion has a long screw reach of not less than 25 mm. Thus, the spark plug exhibits excellent heat radiation characteristics and a prolonged life even under severe operating conditions, such as high load and power output. Since the tail end of the metallic terminal is set back from the tail end of the insulator into the insulator through-hole, a surface discharge passage extending from the tail end of the metallic shell to the tail end of the metallic terminal is relatively long. Accordingly, the length of the tail end portion of the insulator projecting from the tail end of the metallic shell can be shortened, i.e., the overall length of the insulator can be shortened, while the flashover phenomenon is suppressed. As a result, the insulator becomes less likely to bend during the sintering process and improves productivity.

Also, the weight of the spark plug can be decreased accordingly. Thus, the metallic shell becomes less susceptible to loosening, which might otherwise result from vibration or impact.

When A represents an axial distance between the tail end of the insulator and the tail end of the metallic terminal located within the insulator through-hole (i.e., the depth of the setback of the tail end of the metallic terminal), and B represents an axial of the tail end portion of the insulator projecting from the tail end of the metallic shell, a length (A+B) is preferably not less than 20 mm. If the length (A+B) becomes less than 20 mm, the aforementioned flashover phenomenon may occur. Preferably, the length (A+B) is not less than 25 mm.

The above-mentioned depth A of the setback of the tail end of the metallic terminal can be appropriately adjusted according to the length B of the projecting tail end portion of the insulator so that the length (A+B) becomes not less than 20, preferably not less than 25 mm. When the length B of the projecting tail end portion of the insulator is shortened to shorten the overall length of the insulator, the depth A of the setback of the tail end of the metallic terminal is increased accordingly to establish a required length (A+B) of the insulation passage.

In the case of a spark plug used in an automobile gasoline engine, a diameter of the attachment screw portion is often set to a range between 10 mm and 14 mm. In this case, by setting the length B of the projecting tail end portion of the insulator to a range between 9 mm and 20 mm, the overall length of the insulator does not excessively increase, and a screw reach of not less than 25 mm can be easily attained.

The projecting tail end portion of the insulator often has a label, such as a serial number and a manufacturer's name. If the length B of the projecting tail end portion is less than 9 mm, a space for the label may become unavailable. By contrast, if the length B of the projecting tail end portion is in excess of 20 mm, the overall length of the insulator becomes excessive, and the insulator may incur eccentric rotation during the lathing process, or bend during the sintering process. These may potentially result in manufacturing deterioration due to unsatisfactory dimensional accuracy.

The increase in the length of the insulator, moreover, leads to an increase in the weight of the spark plug, and potentially results in loosening of the caulked portion of the metallic shell because of increased inertia of the spark plug when exposure to, for example, vibration or impact. The length B of the projecting tail end portion is preferably a range between 15 mm and 20 mm.

When the maximum diameter of a portion of the insulator projecting from the tail end of the metallic shell is set between, for example, 8 mm and 12 mm, the overall axial length of the insulator is preferably between 50 mm and 69 mm. If the overall axial length of the insulator is less than 50 mm, it is difficult to make the length B of the projecting tail end portion of the insulator not less than 9 mm and make the screw reach of the attachment screw portion not less than 25 mm. By contrast, if the overall axial length of the insulator is more than 69 mm, manufacturing deterioration may occur for the aforementioned reasons, or the weight of the spark plug may increase.

BRIEF DESCRIPTION OF THE DRAWINGS

The accompanying drawings, which are incorporated in and constitute a part of this specification, illustrate several embodiments of the invention and together with the description, serve to explain the principles of the invention. In the drawings.

DESCRIPTION OF THE PREFERRED EMBODIMENTS

Reference will now be made in detail to the present preferred embodiments of the invention, examples of which are illustrated in the accompanying drawings. Wherever possible, the same reference numbers will be used throughout the drawings to refer to the same or like parts.

Embodiments of the present invention will now be described in detail with reference to the drawings.

Figure 1A:
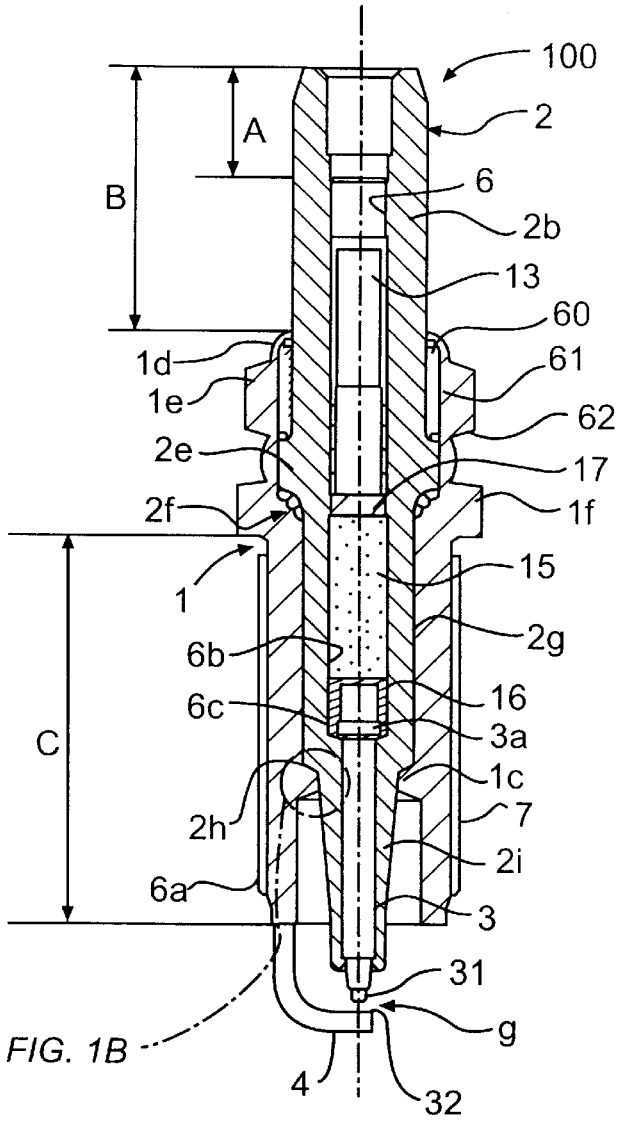
FIG. 1A is a longitudinal sectional view of a spark plug according to the present invention.
Figure 1B:
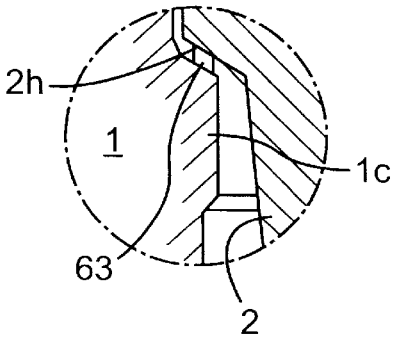
FIG. 1B is an enlarged view of a portion of the spark plug of FIG. 1A.
Figure 2:
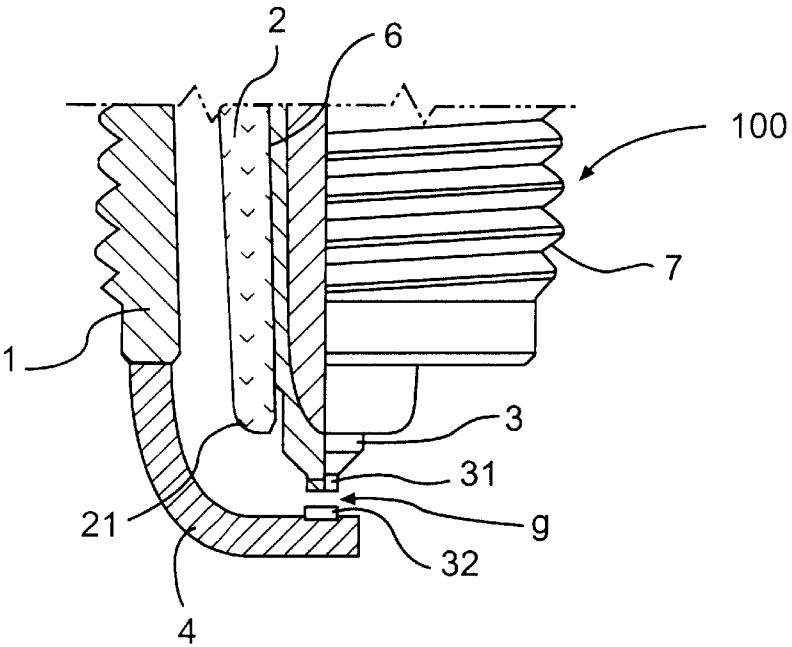
FIG. 2 is a partial sectional view of a main portion of the spark plug of FIG. 1.

As illustrated in FIGS. 1 and 2, a spark plug 100 includes a cylindrical metallic shell 1, an insulator 2, a center electrode 3, and a ground electrode 4. The insulator 2 is fitted into the metallic shell 1 such that a tip portion 21 of the insulator 2 projects from the metallic shell 1. The center electrode 3 is disposed inside the insulator 2 such that a tip spark portion 31 of the center electrode 3 projects from the insulator 2. One end of the ground electrode 4 is connected to the metallic shell 1 by welding or a similar method, while the other end portion of the ground electrode 4 is bent such that the side surface thereof faces the tip of the center electrode 3. A spark portion 32 is formed on the ground electrode 4 in such a manner as to face the spark portion 31 of the center electrode 3. A gap between the spark portions 31 and 32 serves as a spark discharge gap g.

A through-hole 6 is axially formed in the insulator 2. A metallic terminal 13 is inserted into the through-hole 6 and is fixedly located at one end of the through-hole, whereas the center electrode 3 is inserted into the through-hole 6 and is fixedly located at the other end. A resistor 15 is disposed, in the through-hole 6, between the metallic terminal 13 and the center electrode 3. The opposite ends of the resistor 15 are electrically connected to the center electrode 3 and the metallic terminal 13 via conductive glass seal layers 16 and 17, respectively. The resistor 15 is formed by the steps of mixing a glass powder and a powder of a conductive material (and a ceramic powder as needed), and sintering the composition by a hot press or a similar apparatus. The resistor 15 and the conductive glass seal layers 16 and 17 constitute a conductive coupled layer. The resistor 15 and the conductive glass seal layers 16 and 17, however, may be omitted, and the metallic terminal 13 and the center electrode 3 may be integrated.

The tail end portion of the insulator 2 projects from the tail end of the metallic shell 1. An attachment screw portion 7 is formed on the peripheral surface of the metallic shell 1 at the tip end side thereof. An outwardly projecting, flange-shaped gas seal portion if is circumferentially formed on the peripheral surface of the metallic shell 1 at a position located on the tail end side of the attachment screw portion 7. The length C as measured in the axial direction of the metallic shell 1 between the tip-side end surface of the gas seal portion If and the tip-side end surface of the metallic shell 1 is defined as a screw reach ("screw reach C" hereinafter). Preferably, the screw reach is not less than 25 mm.

The tail end of the metallic terminal 13 is set back from the tail end of the insulator 2 into the insulator through-hole 6. When A represents the distance between the tail end of the insulator 2 and the tail end of the metallic terminal 13 located within the insulator through-hole 6 (i.e., the depth of the setback of the tail end of the metallic terminal 13), and B represents the length of the projecting tail end portion of the insulator 2 as measured from the tail end surface of the metallic shell 1, both measured along the axial direction of the through-hole 6 of the insulator 2, the length (A+B) is less than 20 mm, preferably not less than 25 mm. Preferably, the screw reach C is approximately 26.5 mm. A diameter of the attachment screw portion 7 of the metallic shell 1 may be between 10 mm and 14 mm. In this case, the above-mentioned length B may be in a range between 9 mm and 20 mm. For example, in the spark plug 100 shown in FIG. 1, the length A is 7.5 mm, the length B is 17.5 mm, the length (A+B) is 25 mm, and the diameter of the attachment screw portion 7 is 14 mm.

As shown in FIG. 1, the outwardly projecting, flange-shaped circumferential projection 2*e* is circumferentially formed on the insulator 2 at an axially intermediate position. A body portion 2*b* having a diameter smaller than that of the circumferential projection 2*e* extends axially toward the tail end side from the circumferential projection 2*e*. A first shaft portion 2*g* having a diameter smaller than that of the circumferential projection 2*e* and a second shaft portion 2*i* having a diameter smaller than that of the second shaft portion 2*g* extend sequentially and axially toward the tip end side from the circumferential projection 2*e*. A glaze (not shown) is applied onto the peripheral surface of the body portion 2*b*. The first shaft portion 2*g* has a substantially cylindrical shape. The second shaft portion 2*i* has a substantially conical shape, whose diameter decreases toward its tip end.

The diameter of the cross section of the center electrode 3 is smaller than that of the resistor 15. The through-hole 6 formed in the insulator 2 includes a substantially cylindrical first portion 6*a* and a substantially cylindrical second portion 6*b*. The center electrode 3 is inserted through the first portion 6*a*. The second portion 6*b* is located on the tail end side (on the upper side in FIG. 1) of the first portion 6*a* and has a diameter larger than that of the first portion 6*a*. As shown in FIG. 1, the metallic terminal 13 and the resister 15 are accommodated within the second portion 6*b*, and the center electrode 3 is inserted through the first portion 6*a*. A circumferential projection 3*a* projects outwardly from the peripheral surface of a tail end portion of the center electrode 3 and secures the center electrode 3. The first portion 6*a* and the second portion 6*b* are connected within the first shaft portion 2*g*. At the connection position, a projection reception surface 6*c* is formed on a tapered surface or a radius surface for receiving the circumferential projection 3*a* to secure the center electrode 3.

A transitional portion 2*h* between the first shaft portion 2*g* and the second shaft portion 2*i* has a stepped peripheral surface. The transitional portion 2*h* engages with an inner projection 1*c* formed on the inner surface of the metallic shell 1 and serving as an engagement portion of the metallic shell 1, via a ring-shaped sheet packing 63, and prevents the insulator 2 from slipping off the metallic shell 1 in the axial direction. A ring-shaped thread packing 62 and a ring-shaped packing 60, which is located on the tail end side in relation to the packing 62, are disposed between the inner surface of the tail-side end portion of the metallic shell 1 and the peripheral surface of the insulator 2 in the following manner. The packing 62 is disposed along the circumferential edge of the tail end side of the circumferential projection 2*e* of the insulator 2. A filler layer 61 of talc or a like material is disposed between the packing 62 and the packing 60. When the insulator 2 is attached to the metallic shell 1, the insulator 2 is pressed into the metallic shell 1 through the tail end opening of the metallic shell 1. Then, the tail-side edge of the metallic shell 1 is caulked and a caulked portion 1*d* is formed and thus the insulator 2 is fixedly attached into the metallic shell 1.

Preferable dimensional ranges of the insulator 2 are described below with reference to FIG. 4.

Overal length L1: 50 to 69 mm

Length L2 of first shaft portion 2*g*: 0 to 41 mm (excluding a transitional portion 2*f* and including the transitional portion 2*h*)

Length L3 of second shaft portion 2*i*: 7 to 20 mm

Diameter D1 of body portion 2*b*: 8 to 12 mm

Diameter D2 of circumferential projection 2*e*: 10.5 to 15.2 mm

Diameter D3 of first shaft portion 2*g*: 4.8 to 9.5 mm

Diameter D4 of root of second shaft portion 2*i*: 3.5 to 7 mm

Diameter D5 of tip of second shaft portion 2*i* (when the peripheral edge of the tip is curved or chamfered, the diameter D5 is measured on a cross section including a center axis O at a position of the root of curving or chamfering): 2.7 to 6 mm Bore diameter D6 of second portion 6*b* of through-hole 6: 3 to 5 mm Bore diameter D7 of first portion 6*a* of through-hole 6: 1.7 to 3.2 mm Wall thickness t4 of body portion 2*b* ((D1–D6)/2 or wall thickness of projecting tail end portion of insulator 2 projecting from tail end surface of metallic shell 1): 2.5 to 3.5 mm L1/D1: 5.5 to 6.3

Wall thickness t1 of first shaft portion 2*g*: 0.9 to 2.25 mm

Wall thickness t2 of root of second shaft portion 2*i* (as measured in a direction perpendicular to center axis O): 0.9 to 1.9 mm Wall thickness t3 of tip of second shaft portion 2*i* (as measured in a direction perpendicular to center axis O; however, when the peripheral edge of the tip is curved or chamfered, the wall thickness t3 is measured on a cross section including a center axis O at a position of the root of curving or chamfering): 0.5 to 1.4 mm Average wall thickness tA ((t1+t2)/2): 0.9 to 2.1 mm If wall thicknesses t1 to t4 are less than the above-mentioned respective lower limits, the dielectric strength of the insulator 2 may become insufficient. If the ratio L1/D1 is in excess of 6.67, the compacted body of the insulator 2 may incur eccentric rotation during lathing, or the lathed compacted body may bend during sintering, and potentially result in manufacturing deterioration because of unsatisfactory dimensional accuracy.

Figure 4A:
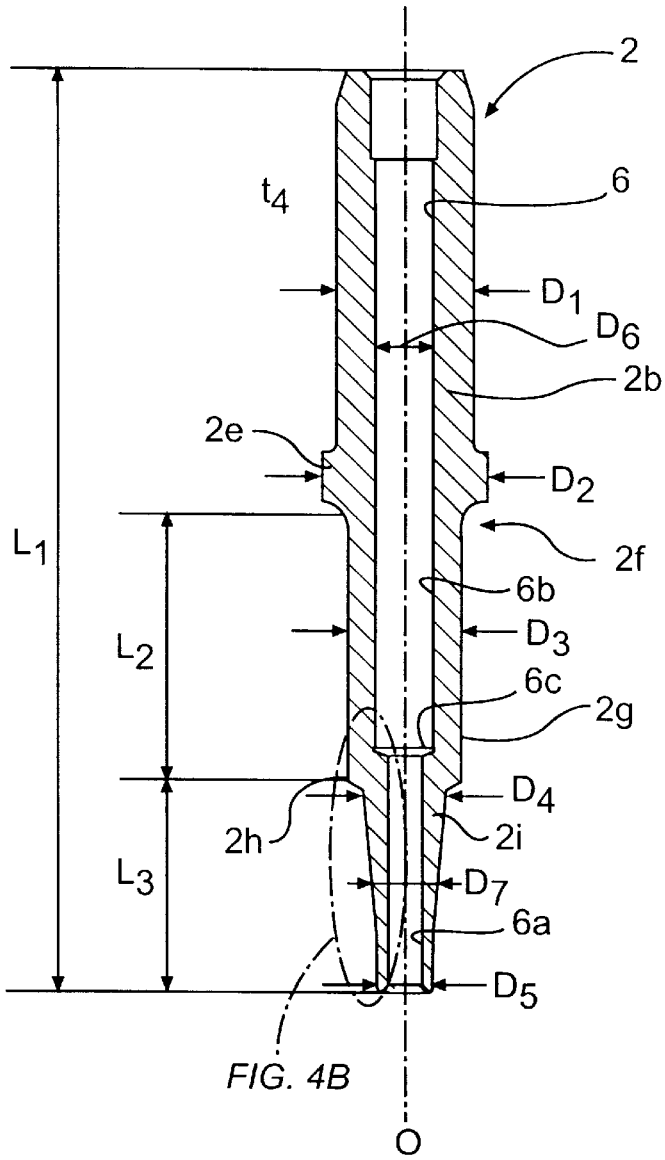
FIG. 4A is a longitudinal sectional view of the insulator of the spark plug of FIG. 1.
Figure 4B:
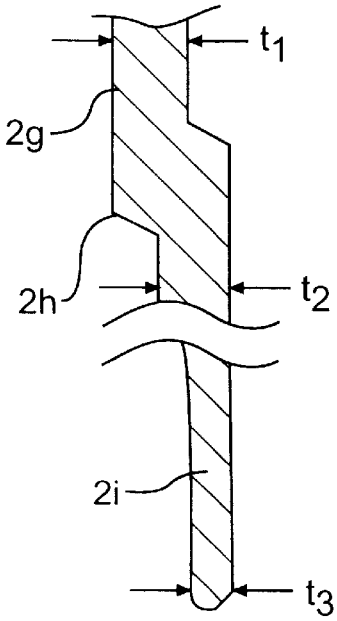
FIG. 4B is an enlarged view of a portion of the insulator of FIG. 4A.

In the present embodiment, the above listed dimensions of the insulator 2 as shown in FIG. 4 are, for example, as follows: L1=61.5 mm; L2=35 mm; L3=14 mm; D1=10.5 mm; D2=12.9 mm; D3=9.2 mm; D4=6.9 mm; D5=5.1 mm; D6=3.9 mm; D7=2.7 mm; t1=2.65 mm; t2=2.1 mm; t3=1.2 mm; and tA=2.4 mm.

Figure 3:
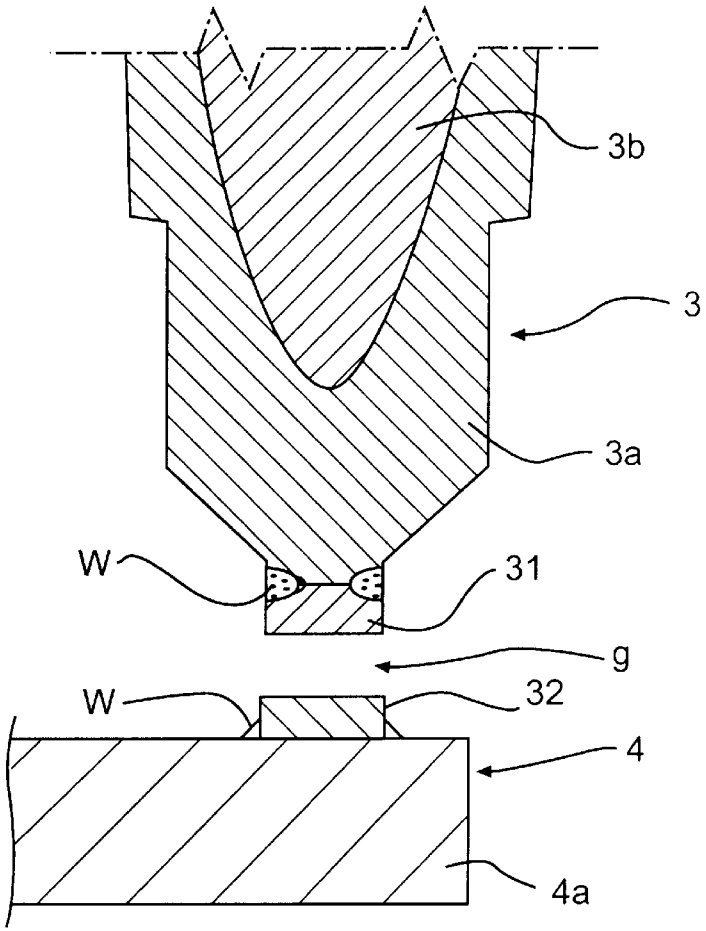
FIG. 3 is an enlarged sectional view of the spark portion and neighboring portions of the spark plug of FIG. 1.

In FIG. 3, the body portion 3*a* of the center electrode 3 and a body portion 4*a* of the ground electrode 4 are made of an Ni alloy or a similar metal. In order to accelerate the heat radiation, a core (not shown) of Cu, a Cu alloy, or a similar metal is embedded in the center electrode 3. The spark portion 31 and the facing spark portion 32 are made primarily of a noble metal alloy which contains, as a main component, noble metal selected singly or in combination from the group consisting of Ir, Pt, and Rh. A tip section of the body portion 3*a* of the center electrode 3 is tapered such that the diameter reduces toward the tip. The tip surface of the body portion 3*a* is flat. A disk-shaped chip of the above-mentioned alloy composition is placed on the flat tip surface.

Welding, such as laser beam welding, electron beam welding, or resistance welding, is performed along the circumference of the boundary between the chip and the tip of the body portion 3*a*, and forms a weld zone W. The welded chip serves as the spark portion 31. Another chip is positioned on the ground electrode 4 corresponding to the spark portion 31 and is then subjected welding which is performed along the circumference of the boundary between the chip and the ground electrode 4, and forms the weld zone W. The welded chip serves as the spark portion 32. These chips are formed of a sintered material obtained by forming and sintering any of the following materials: a material obtained by mixing alloy components of a composition described below and melting the resulting mixture; a powder of an alloy described below; and a mixture obtained by mixing component metal powders at predetermined ratios. Either the spark portion 31 or the opposed spark portion 32 may be omitted.

An alloy for forming the spark portion 31 or 32 (or the corresponding chip) may be composed primarily of a noble metal alloy which contains, as a main component, noble metal selected singly or in combination from the group consisting of Ir, Pt, and Rh. For example, in the case of using an alloy which contains Pt as a base metal, a Pt—Ni alloy (containing Pt in an amount of, for example, 1% to 30% by weight) may be used preferably.

Figure 5:
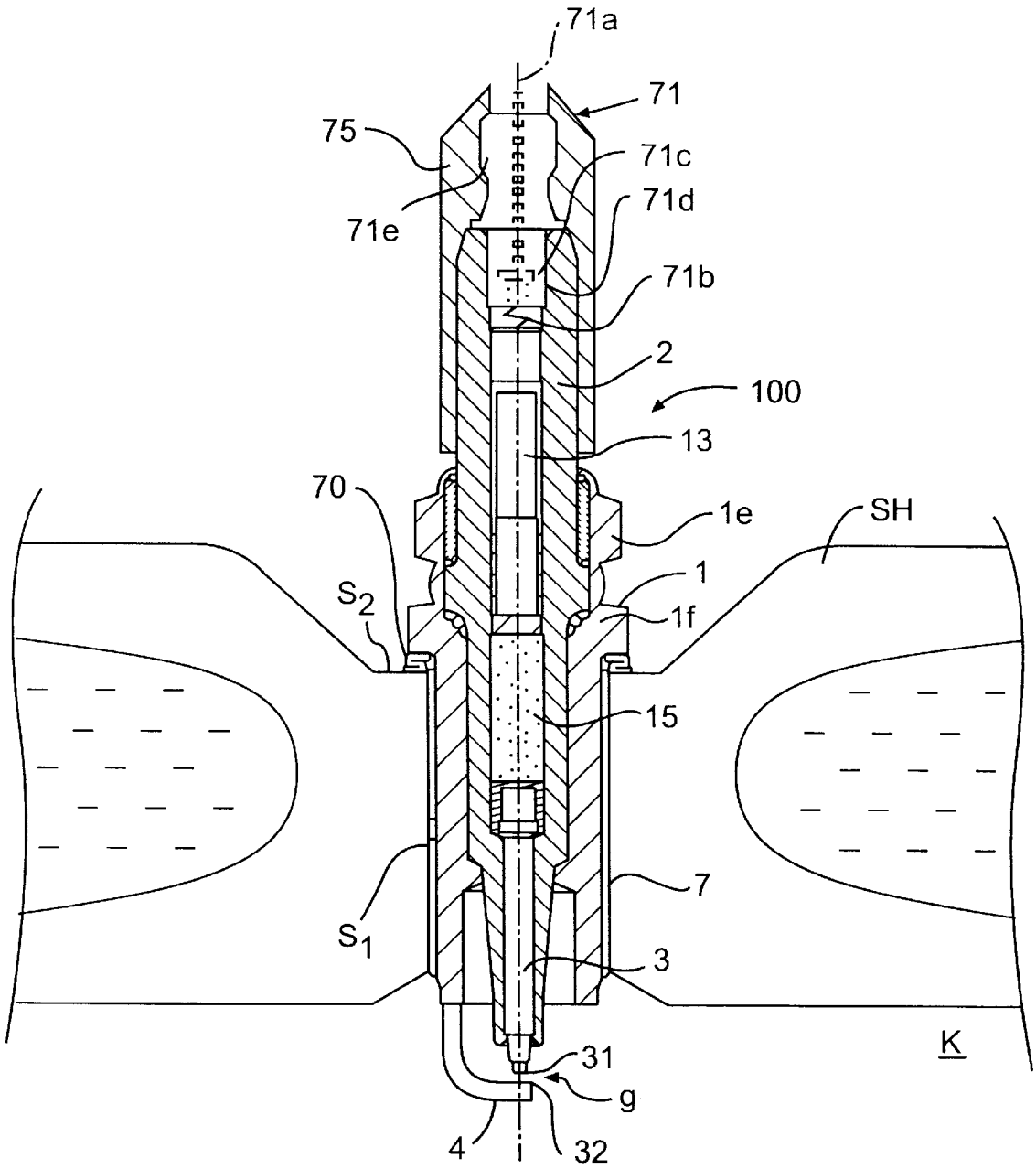
FIG. 5 is a longitudinal sectional view showing an installation example of the spark plug of FIG. 1.

The operation of the spark plug 100 will next be described. As shown in FIG. 5, the attachment screw portion 7 is engaged with a female screw portion S1 of the cylinder head SH, so that the spark plug 100 is used to ignite the air-fuel mixture supplied into the combustion chamber K. A metallic gasket 70 is fitted onto the root portion of the attachment screw portion 7. The gasket 70 has a cross section of, for example, letter S. As a result of screwing the attachment screw portion 7 into the female screw portion S1, the gasket 70 is crushed between the gas seal portion If and an open circumferential edge portion S2 of the female portion S1, thereby sealing the female screw portion S1 against the attachment screw portion 7.

A terminal portion 71*c* of a high-tension cord 71 is attached into the tail end portion of the through-hole 6. The terminal portion 71*c* is provided with a collar 71*e*, which covers a sheath 71*d* of a core wire 71*a* such that an end portion of the sheath 71*d* projects from the collar 71*e*. The projecting end portion of the sheath 71*d* is inserted into the through-hole 6. A rubber cap 75 covers the collar 71*e* as well as a tail end portion of the insulator 2. The friction between the inner surface of the rubber cap 75 and the outer surface of the insulator 2 causes the high-tension cord 71 to be fixed in relation to the spark plug 100. Notably, a spring 71*b* attached to the end of the core wire 71*a* is compressed against the metallic terminal 13, thereby establishing electrical conductance between the core wire 71*a* and the metallic terminal 13.

In the above-described spark plug 100, the attachment screw portion 7 has a long screw reach C of not less than 25 mm. Thus, the spark plug 100 exhibits excellent heat radiation characteristics and enjoys a prolonged life even under severe operating conditions of high load and high power output. Furthermore, the tail end of the metallic terminal 13 is set back from the tail end of the insulator 2 into the through-hole 6. Specifically, the aforementioned length (A+B) (i.e., the length of an insulation passage) is at least 20 mm (preferably, at least 25 mm). The insulator 2 is not excessively long and enables excellent productivity, and less susceptible to flashover.

Figure 6:
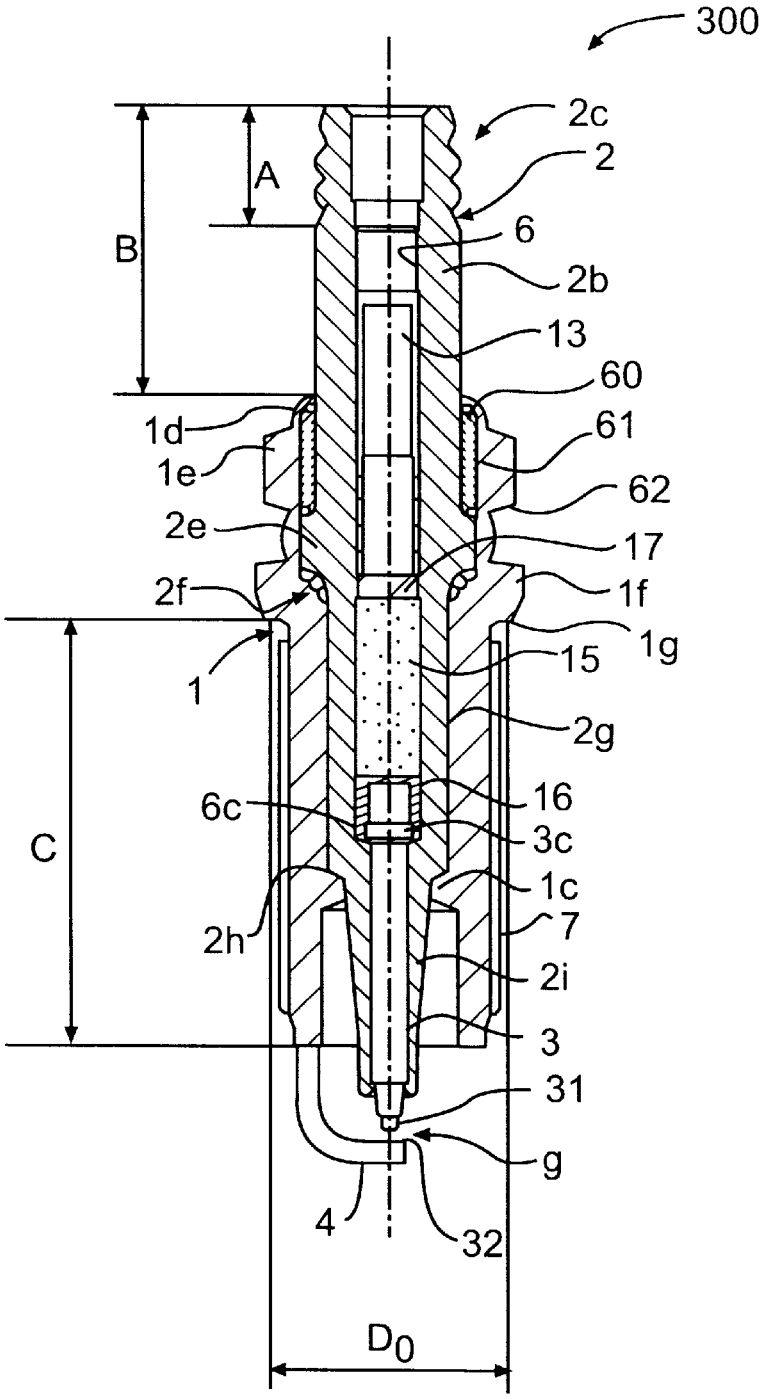
FIG. 6 is a longitudinal sectional view showing a modification of the spark plug of FIG. 1.
Figure 7:
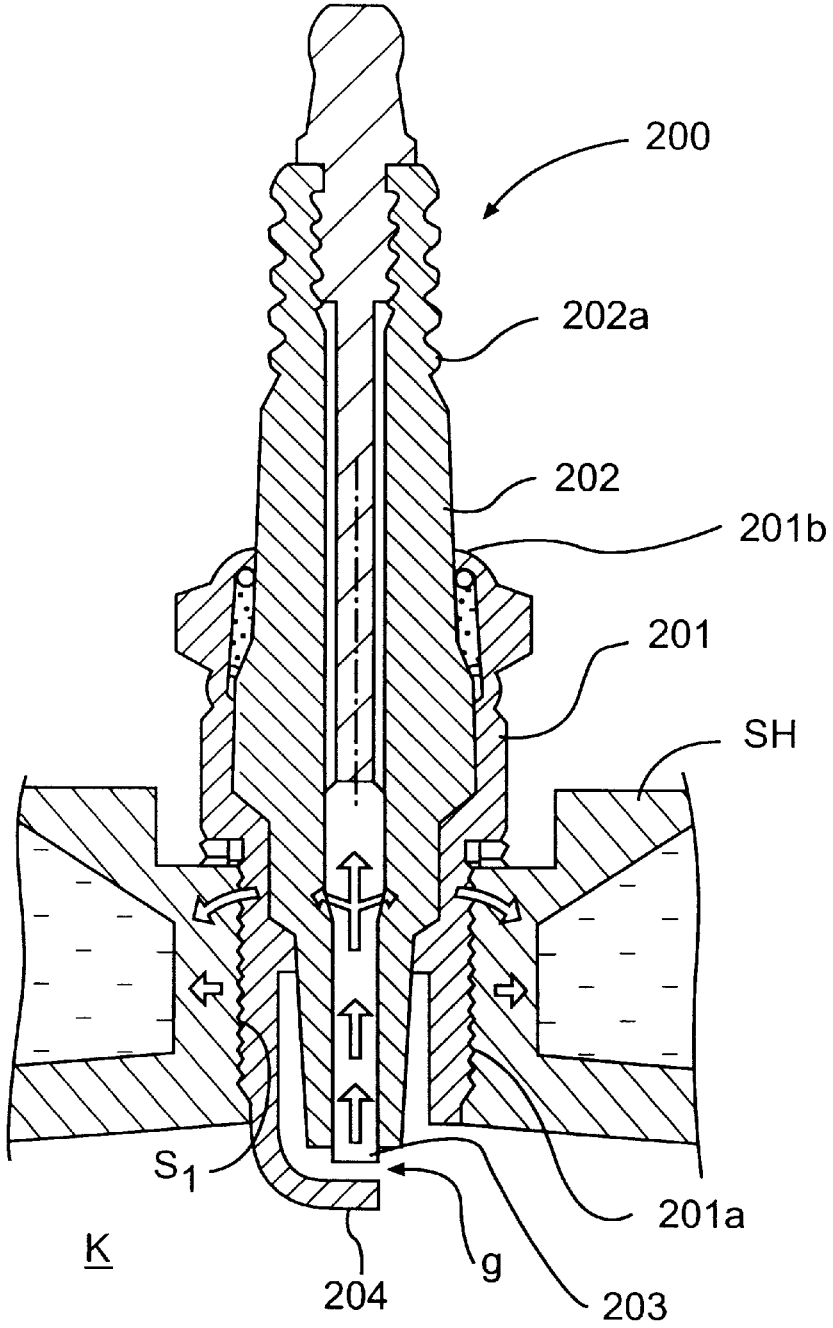
FIG. 7 (PRIOR ART)
FIG. 7 is a longitudinal sectional view showing a conventional spark plug.

FIG. 6 shows a modified embodiment of the spark plug 100 of FIG. 1. Since a spark plug 300 of FIG. 6 shares many common portions with the spark plug 100 of FIG. 1, distinctions to the spark plug 100 will be mainly described. The common portions will be denoted by common reference numerals, and the description of the common portions will be omitted.

First, corrugations 2*c* are formed on the peripheral surface of a tail end portion of the insulator 2. The corrugations 2*c* further increase the length of the surface discharge passage extending on the surface of the insulator 2 from the tail end of the metallic shell 1 to the tail end of the metallic terminal 13, so that flashover is less likely to occur. In this case, on a cross section at the axis of the insulator 2, the axial distance between the tail end of the metallic shell 1 and the tail end of the metallic terminal 13 along the insulator 2 is not less than 20 mm, preferably not less than 25 mm (25 mm in the present embodiment).

Also, in the metallic shell 1, the surface of the gas seal portion If on the tip end side forms a taper seat portion 1*g* having a conical surface. In this case, the taper seat portion 1*g* belongs to the gas seal portion 1*f*, and the screw reach C is defined as the distance between the tip end position of the metallic shell 1 and the position where the taper seat portion 1*g* has a reference diameter D0 (as prescribed in ISO2344:1992(E)). The spark plug 300 of FIG. 6 has a screw reach C of 25 mm, for example.

EXAMPLES

The present invention will next be described by way of example and with reference to experimental data.

Example 1

The spark plugs 100 of FIG. 1 had the following dimensions: screw reach C=26.5 mm; diameter of attachment screw portion 7=14 mm; and length B=17 mm. The length A was made different among the spark plugs 100. The insulators 2 has the following dimensions: L1=61.5 mm; L2=35 mm; L3=14 mm; D1=10.5 mm; D2 =12.9 mm; D3=9.2 mm; D4=6.9 mm; D5=5.1 mm; D6=3.9 mm; D7=2.65 mm; t2=2.1 mm; t3=1.2 mm; and tA=2.4 mm. In order to prevent a discharge at the spark discharge gap g, the tip end side of each insulator 2 was covered with a silicone tube. Each of the spark plugs 100 was attached to a pressurized chamber. A high-tension lead wire whose periphery was insulated with vinyl was connected to the metallic terminal 13. In this state, a voltage was applied to the spark plug 100 through the connected high-tension lead wire. The applied voltage level was increased at a rate of 0.1 to 1.5 kV/sec to thereby measure a threshold voltage at which the flashover phenomenon occurs. The results are shown in Table 1.

TABLE 1

| No. | Length A (mm) | Length (A + B) (mm) | Threshold voltage of flashover (kV) |
|---|---|---|---|
| 1 | 0 | 17 | 20 |
| 2 | 5 | 22 | 26 |
| 3 | 7 | 24 | 28 |
| 4 | 0 | 25 | 29 |
| 5 | 10 | 27 | 30 |
| 6 | 32 | 49 | 33 |

B = 17 mm

As seen from Table 1, when the length (A+B) is not less than 20 mm, the threshold voltage assumes a high value in excess of 20 kV, indicating that the flashover phenomenon is less likely to occur.

Example 2

The insulators 2 of FIG. 4 were manufactured as follows. Material powders were mixed in the following manner:

$Al_2O_3$ (average grain size 1.5 μm) 95.0 parts by weight; $SiO_2$(average grain size 1.5 μm) 2.5 parts by weight; CaO (average grain size 1.5 μm) 2.0 parts by weight; MgO (average grain size 1.5 μm) 0.1 parts by weight; BaO (average grain size 1.5 μm) 0.2 parts by weight; and $B_2O_3$ (average grain size 1.5 μm) 0.2 parts by weight. To the resulting mixture, predetermined amounts of a binder and water were added and wet mixing was performed. The wet mixture was dried by a spray dry method, yielding a granulated material. The obtained granules were compacted into a predetermined shape by use of a rubber press. The compacted bodies were sintered at a temperature of about 1570° C. for 1.5 hours, and the insulators 2 of FIG. 4 were obtained.

The insulators 2 had the following dimensions: L3=14 mm; D1=10.5 mm; D2=12.9 mm; D3=9.2 mm; D4=6.9 mm; D5=5.1 mm; D6=3.9 mm; D7=2.7 mm; t1=2.65 mm; t2=2.1 mm; t3=1.2 mm; and tA=2.4 mm. Among the insulators 2, the length L1 made different at a range of 50 mm to 80 mm, and the length L2 was made different at a range of 15 mm to 29 mm. When the insulators 2 were attached into the sponding metallic shells having dimensions similar to those of the metallic shells of the spark plugs of Example 1, the length B (FIG. 1) was between 9 mm and 25 mm. 200 insulators 2 were manufactured with each value of the length L1 (or the length B). Each of the insulators 2 was rotated about the centerline of the body portion 2*b* and was evaluated according to the following criteria: the insulator 2 is not defective if the deflection of the tip end portion of the insulator 2 is not greater than 0.15 mm; and the insulator 2 is defective if the deflection is greater than 0.15 mm. Defective percentage was obtained for each value of the overall length L1. The results are shown in table 2

TABLE 2

| Entire length L1 (mm) | Length B (mm) | L1/D1 | Percent defective (%) |
|---|---|---|---|
| 50 | 9 | 4.76 | 0 |
| 60 | 19 | 5.71 | 0 |
| 70 | 29 | 6.67 | 30 |
| 80 | 39 | 7.62 | 65 |

As seen from Table 2, at a length L1 of not greater than 60 mm and at a ratio L1/D1 of not greater than 5.71, the defective percentage decreases.

It will be apparent to those skilled in the art that various modifications and variations can be made in the spark plug of the present invention without departing from the scope or spirit of the invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A spark plug for attachment to a cylinder head, comprising:

a metallic shell including a tip-end side having an open tip end and a tail-end side having an open tail end, the metallic shell having an attachment screw portion peripherally formed at the tip-end side thereof;

a ground electrode attached onto the tip-end side of the metallic shell;

an insulator including an axial through-hole formed therein and a tail end portion having a tail end, the insulator disposed within the metallic shell such that the tail end portion of the insulator substantially projects from the tail end of the metallic shell;

a center electrode having a tip end and being disposed within the through-hole and facing the ground electrode to define a spark discharge gap therebetween; and a metallic terminal having a tail end and being disposed within the through-hole of the insulator such that the tail end of the metallic terminal is set back from the tail end of the insulator into the through-hole, the metallic terminal being electrically connected with the center electrode, wherein the metallic terminal and the tail end of the metallic shell are separated with a distance for preventing an electrical discharge therebetween, and wherein, when A represents a distance between the tail end of the insulator and the tail end of the metallic terminal disposed within the through-hole, and B represents a length of the tail end portion of the insulator projecting from the tail end of the metallic shell along the axial direction of the through-hole of the insulator, a length of (A+B) is at least 20 mm.

2. The spark plug according to claim 1, wherein the metallic shell has a flange-shaped gas seal portion circumferentially formed at the tail-end side of the metallic shell, and an axial length of the metallic shell between the gas seal portion and the tip end of the metallic shell, defined as a screw reach, is at least 25 mm.

3. The spark plug according to claim 1, wherein a diameter of the attachment screw portion is between 10 mm and 14 mm, and the length B of the tail end portion of the insulator is between 9 mm and 20 mm.

4. The spark plug according to claim 3, wherein a maximum diameter of the tail end portion of the insulator projecting from the tail end of the metallic shell is between 8 mm and 12 mm, and an overall axial length of the insulator is between 50 mm and 69 mm.

5. The spark plug according to claim 4, wherein the metallic terminal is formed integrally with the center electrode.

6. The spark plug according to claim 4, wherein the metallic terminal is coupled with the center electrode via a conductive coupling layer.

7. The spark plug according to claim 3, wherein a maximum diameter of the tail end portion of the insulator projecting from the tail end of the metallic shell is between 8 mm and 12 mm, and an overall axial length of the insulator is between 50 mm and 69 mm.

8. The spark plug according to claim 7, wherein the metallic terminal is formed integrally with the center electrode.

9. The spark plug according to claim 7, wherein the metallic terminal is coupled with the center electrode via a conductive coupling layer.

10. The spark plug according to claim 7, wherein the metallic terminal is coupled with the center electrode via a conductive coupling layer.

11. The spark plug according to claim 1, wherein a maximum diameter of the tail end portion of the insulator projecting from the tail end of the metallic shell is between 8 mm and 12 mm, and an overall axial length of the insulator is between 50 mm and 69 mm.

12. The spark plug according to claim 11, wherein the metallic terminal is formed integrally with the center electrode.

13. The spark plug according to claim 11, wherein the metallic terminal is coupled with the center electrode via a conductive coupling layer.

* * * * *